US006577919B1

(12) United States Patent
Tomonaga et al.

(10) Patent No.: US 6,577,919 B1
(45) Date of Patent: Jun. 10, 2003

(54) BLOW MOLDING METHOD FOR SUPERPLASTIC MATERIAL AND SYSTEM

(75) Inventors: Junnichi Tomonaga, Toyokawa (JP); Hiroyasu Makino, Toyokawa (JP)

(73) Assignee: Sintokogio, Ltd., Aichi-ken (JP)

( * ) Notice: Subject to any disclaimer, the term of this patent is extended or adjusted under 35 U.S.C. 154(b) by 0 days.

(21) Appl. No.: 09/831,826

(22) PCT Filed: Sep. 13, 2000

(86) PCT No.: PCT/JP00/06262

§ 371 (c)(1),
(2), (4) Date: Aug. 17, 2001

(87) PCT Pub. No.: WO01/19546

PCT Pub. Date: Mar. 22, 2001

(30) Foreign Application Priority Data

Sep. 16, 1999 (JP) ..... 11-261610

(51) Int. Cl.[7] ..... B29C 49/00

(52) U.S. Cl. ..... 700/197; 700/203; 700/204; 164/6; 72/61

(58) Field of Search ..... 700/197, 42, 118, 700/203, 204; 425/522; 264/328.1; 164/6

(56) References Cited

U.S. PATENT DOCUMENTS 3,896,648 A * 7/1975 Schertenleib ..... 29/421.1
4,983,898 A * 1/1991 Kanda ..... 318/561
5,578,256 A * 11/1996 Austin ..... 264/328.1

* cited by examiner

*Primary Examiner*—Leo Picard
*Assistant Examiner*—Carlos R. Ortiz
(74) *Attorney, Agent, or Firm*—Finnegan, Henderson, Farabow, Garrett & Dunner, LLP

(57) ABSTRACT

A method for blow molding a superplastic metal plate by in relation to time applying to it pneumatic pressure that is based on a maximum value of a strain rate of the superplastic metal plate as a set pattern of pneumatic pressure in relation to time when the metal plate is subjected to a high-speed blow molding after being heated to a desired temperature, comprising the steps of: entering data on a shape into which the metal sheet is to be blow molded and on properties of a material of the metal plate to store the data in a storage; determining a set pattern of a pneumatic pressure in relation to time from the entered data on the shape and the properties of the metal sheet; dividing the set pattern of the pneumatic pressure into an appropriate number of parts in relation to time; determining the values of parameters for controlling the pneumatic pressure for each part divided from the set pattern of the pneumatic pressure; and controlling the pattern of the pneumatic pressure using the determined values of the parameters for controlling the pneumatic pressure.

3 Claims, 7 Drawing Sheets

| | time [s] | proportional band | integral time | derivative time |
|---|---|---|---|---|
| first time zone | 0 - 30 | 19.2 | 4 | 1 |
| second time zone | 30 - | 4.8 | 7 | 1 |

Fig. 6

BLOW MOLDING METHOD FOR SUPERPLASTIC MATERIAL AND SYSTEM

FIELD OF THE INVENTION

This invention relates to a method and a system for blow molding a superplastic metal plate by applying to it a pattern of pneumatic pressure (a curve of the pneumatic pressure in relation to time) that is based on the maximum value of the strain rate of the superplastic plate as a set pattern of pneumatic pressure in relation to time when the superplastic plate is subjected to a high-speed blow molding.

DESCRIPTION OF THE PRIOR ART

Recently a method has been developed for blow molding a superplastic plate such as an aluminum plate after it has been heated to a desired temperature. Since in this method the shape and the thickness of the plate vary as its formation proceeds, maintaining proper superplastic conditions relating to the strain rate is difficult, and there is a difficulty in achieving a stable formation. Thus, a system for controlling the pneumatic pressure of the blow molding such that the maximum strain rate of the plate is kept constant during its formation has been discussed. In an example of this conventional control system, the maximum value of the strain rate is kept at a desired value (see *Plasticity and Work* [*Journal of the Society of Japan Plastic Work*] 31, 1990, p.1128, by Akio Takahashi, et al., and *Materials Science Forum,* Vols. 304–306, 1990, p.777, by N. Suzuki et al.). Since in this control system the strain rate of superplastic material is in an order of $10^{-3}$ [1/s] and the obtained pattern of pneumatic pressure varies gradually, the strain rate can be easily controlled.

However, recently a high-speed blow molding has been developed, wherein the strain rate of superplastic material is equal to or more than $10^{-2}$ [1/s], which is faster by one order than the conventional strain rate, resulting in less time being required for blow molding it. Since in such a high-speed blow molding the optimal pattern of the pneumatic pressure to keep the maximum value of the strain rate at a desired value varies greatly, it became difficult to control the pattern of the pneumatic pressure as desired by a conventional blow molding machine.

The present invention has been conceived in view of such circumstances. The purpose of it is to provide a method and a system that can appropriately perform blow molding even if the strain rate of a superplastic material is more than $10^{-2}$ [1/s], wherein a pattern of pneumatic pressure based on the maximum value of the strain rate is applied to the material as a set pattern of the pneumatic pressure.

SUMMARY OF THE INVENTION

To the above end, in one aspect the method of the present invention of blow molding superplastic material is a method for blow molding a superplastic metal plate wherein pneumatic pressure in relation to time and based on a maximum value of a strain rate of the superplastic metal plate is applied to the metal plate as a set pattern of pneumatic pressure in relation to time when the metal plate is subjected to a high-speed blow molding after being heated to a desired temperature, comprising the steps of: entering data on a shape into which the metal sheet is to be blow molded and on the properties of a material of the metal plate to store the data in a storage; determining a set pattern of pneumatic pressure in relation to time from the entered data on the shape and the properties of the metal sheet; dividing the set pattern of the pneumatic pressure into an appropriate number of parts in relation to time; determining values of parameters for controlling the pneumatic pressure for each part divided from the set pattern of the pneumatic pressure; and controlling the pattern of the pneumatic pressure using the determined values of the parameters for controlling the pneumatic pressure.

BRIEF DESCRIPTION OF THE DRAWINGS

FIG. 6 is a table showing appropriate conditions of the parameters of the PID control for each of two time zones into which the set pattern of the pneumatic pressure is divided.

DESCRIPTION OF THE PREFERRED EMBODIMENT

The superplastic metal sheet used in this invention is an aluminum-alloy sheet (this is a representative metal), or the like. In this preferred embodiment producing a thin form from a superplastic metal plate by blow molding it is explained. The data on the shape of the thin form are the width, depth, etc., of a mold cavity. The data may be three-dimensional CAD data. Further, the data on the properties of the material of the thin form are values representative of the properties of the superplastic material, including a strain-rate sensitivity exponent (m-value) and a K-value, which K-value is a constant representative of the stress level of the material. These values vary according to materials and their temperatures.

Generally, the property of a superplastic material is expressed in the equation $a\ \sigma = K\ v^{m}$, where $\sigma$ is an equivalent stress, K is a constant representative of the stress level of the material, v is its equivalent strain rate, and m is its strain-rate sensitivity exponent.

Further, the temperature at which the metal plate is heated is, for example, in the case of aluminum, its recrystallization temperature or solidus temperature, i.e., 400–550° C., i.e., generally about 50–80% of the melting point of the material.

Further, the division of a pattern of the pneumatic pressure is to divide a curve of the pneumatic pressure into some parts in relation to time preferably into an area (a time zone) wherein the pressure varies greatly and an area (a time zone) wherein the pressure varies gradually. Further, the controlling parameters are the parameters used for controlling the strain rate. There are three parameters in a PID control that are used in this embodiment i.e., a proportional band, integral time, and derivative time.

The embodiment is now explained in detail by reference to FIGS. 1–7. As in FIG. 2, the blow molding system for the present invention for blow molding a superplastic material includes a computer 2, a conventional input device 1 for inputting conditions for forming in the computer 2, and a blow molding machine 3.

Figure 1:
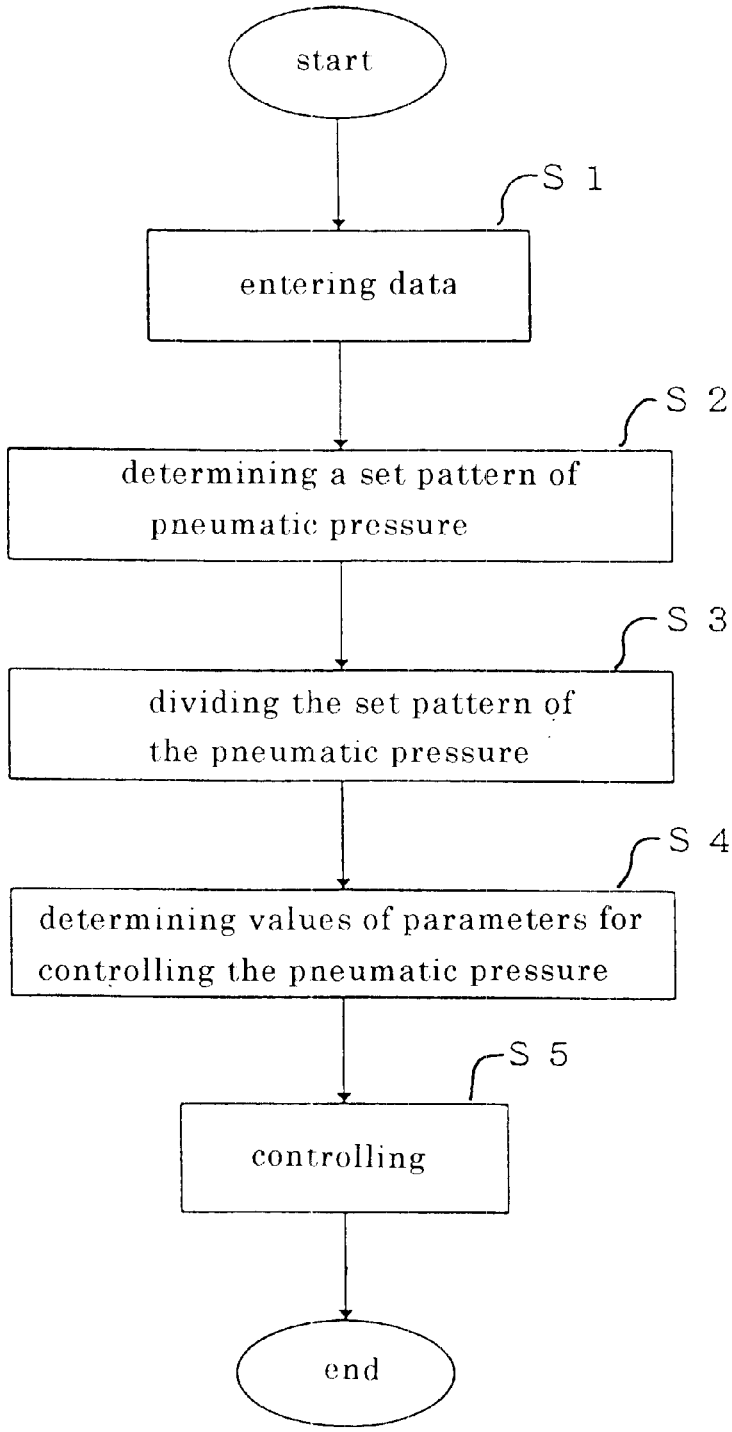
FIG. 1 is a flowchart showing the embodiment of the method of the present invention.
Figure 2:
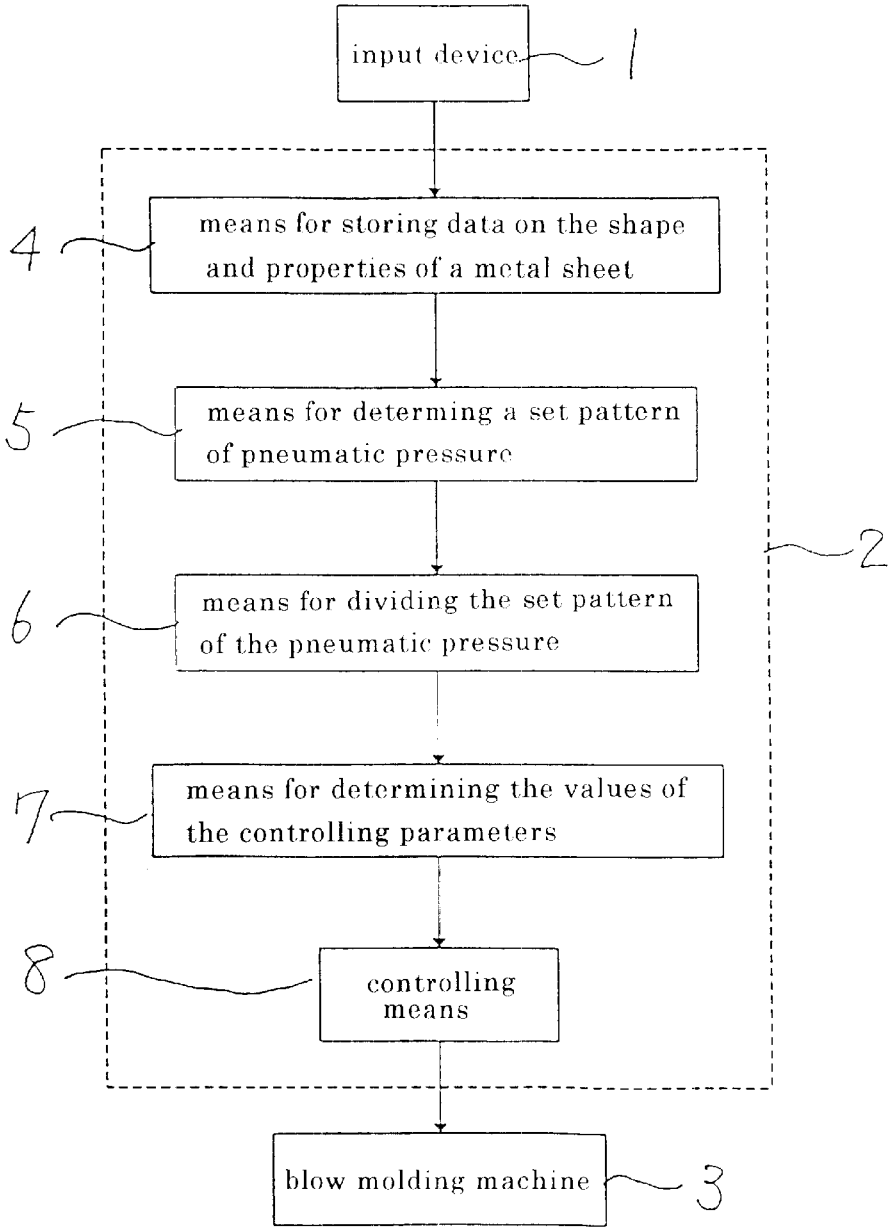
FIG. 2 is a block diagram of the embodiment of the blow molding system of the present invention.

As is shown in FIG. 2, the computer 2 functions as a storage means 4 for storing the inputted data on a shape into which the metal plate is to be formed and on the material of the metal plate, functions as a means 5 for determining a set pattern of a pneumatic pressure in relation to time based on the data on the shape and the material of the metal plate from the storage means 4, functions as a means 6 for dividing the set pattern of the pneumatic pressure into the appropriate number of parts in relation to time (time zones), functions as a means 7 for determining values of parameters for controlling the pneumatic pressure for the part of the set pattern of the pneumatic pressure at each time zone, and functions as a control means 8 for controlling the pattern of the pneumatic pressure using the determined values of the parameters.

Figure 3:
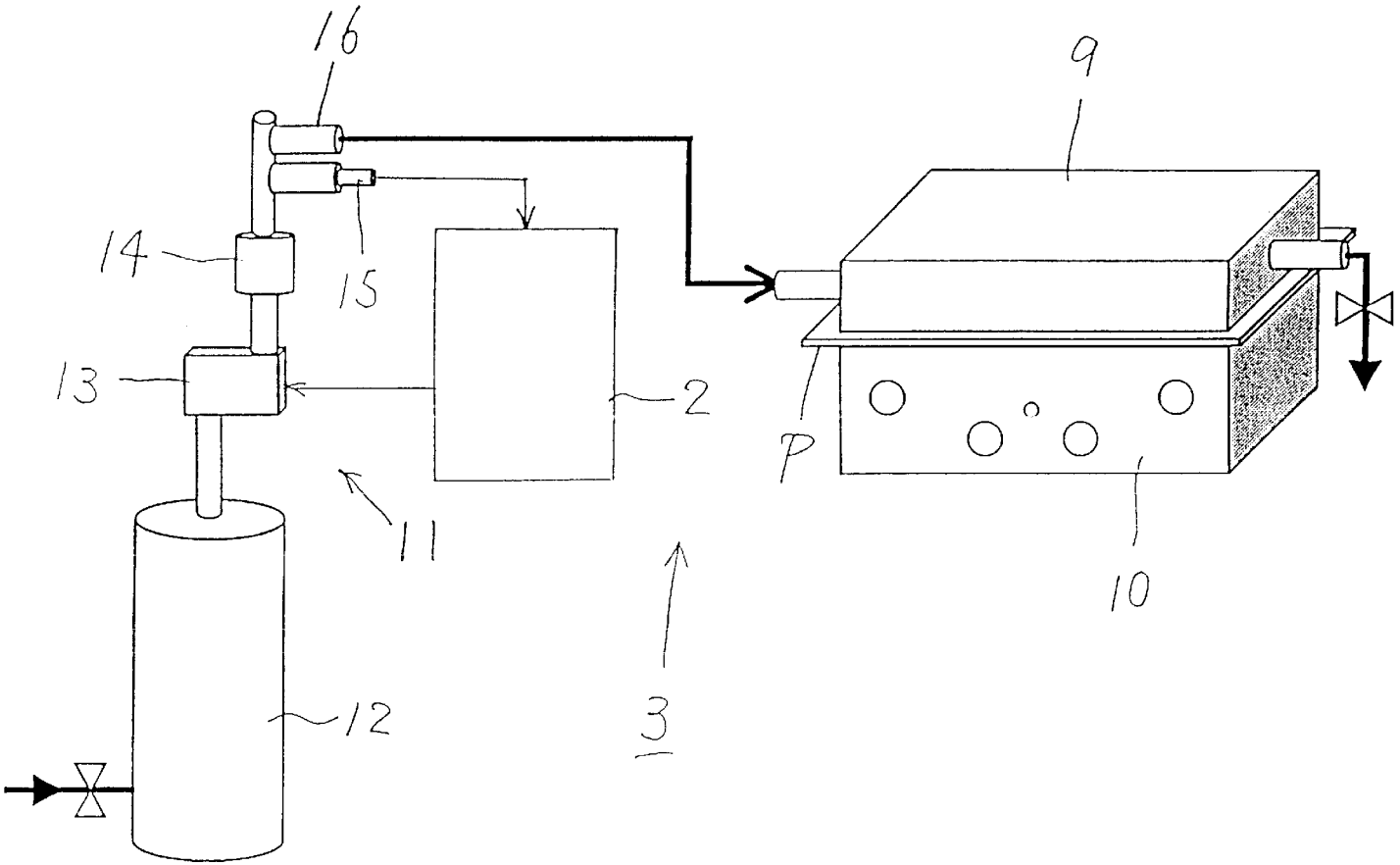
FIG. 3 is a schematic representation of the embodiment of the blow molding system of the present invention.

Further, as is shown in FIG. 3, the blow molding machine 3 includes upper and lower metal molds 9, 10 in which some electric heaters (not shown) are embedded, and means 11 for supplying compressed air to a plate P to blow mold it. The means 11 for supplying compressed air include a tank 12 for storing the compressed air, an electropneumatic proportional control valve in fluid communication with the tank 12, a check valve 14 that connects the tank 12 to the upper and lower molds 9, 10 so that a fluid can communicates between them, a pressure sensor 15, and a pipe 16. The pressure sensor 15 is electrically coupled to the electropneumatic proportional control valve 13 via the computer 2.

The procedure to blow mold the plate P of an aluminum alloy by using the blow molding system arranged as explained above is now explained. First, a value of 100 mm for the diameter of the mold cavity, which is the data on the molds (i.e., data on the shape into which the plate is formed), is entered in the computer 2 from the input device 1, and also the data on the properties of the material, namely, the thickness of 1 mm, and the strain-rate sensitivity exponent (m-value) 0.322, K-value $9.23\times10^{-7}$, which represents the stress level, are entered in the computer 2 from the input device 1 (step S1). Then while the upper and lower molds 9, 10 are being heated to 500° C., the plate P is set between them. The computer 2 then determines a set pattern of the pneumatic pressure (the theoretically set values of the pressure) in relation to time when the means 5 is operated under the control of the computer 2 (step S2).

Generally, the blow molding has the pressure pattern wherein the pressure first rises and then descends.

Further, in the high-speed blow molding the pressure pattern becomes shorter in relation to time, and the pressure level becomes higher. Although in this embodiment the pressure rises to 0.5 MPa ($5\times10^5$ Pa) over 30 seconds and then drops gradually to 0.35 MPa during the next 60 seconds, it may vary more greatly if other conditions than those for this embodiment are selected.

To precisely control the pressure that varies greatly is very important in controlling the strain rate and forming rate of the plate. In this embodiment a PID control, which is the simplest feedback control, is used for controlling the pressure. In this PID control it is important to determine the optimum values for the three parameters, namely, the proportional band, integral time, and derivative time. For fixed command controls, the Ziegler Nichols method (the limiting sensitivity method and the step response method) and the CHR method (the Chien, Hrones, and Reswick method) have been proposed.

Figure 4:
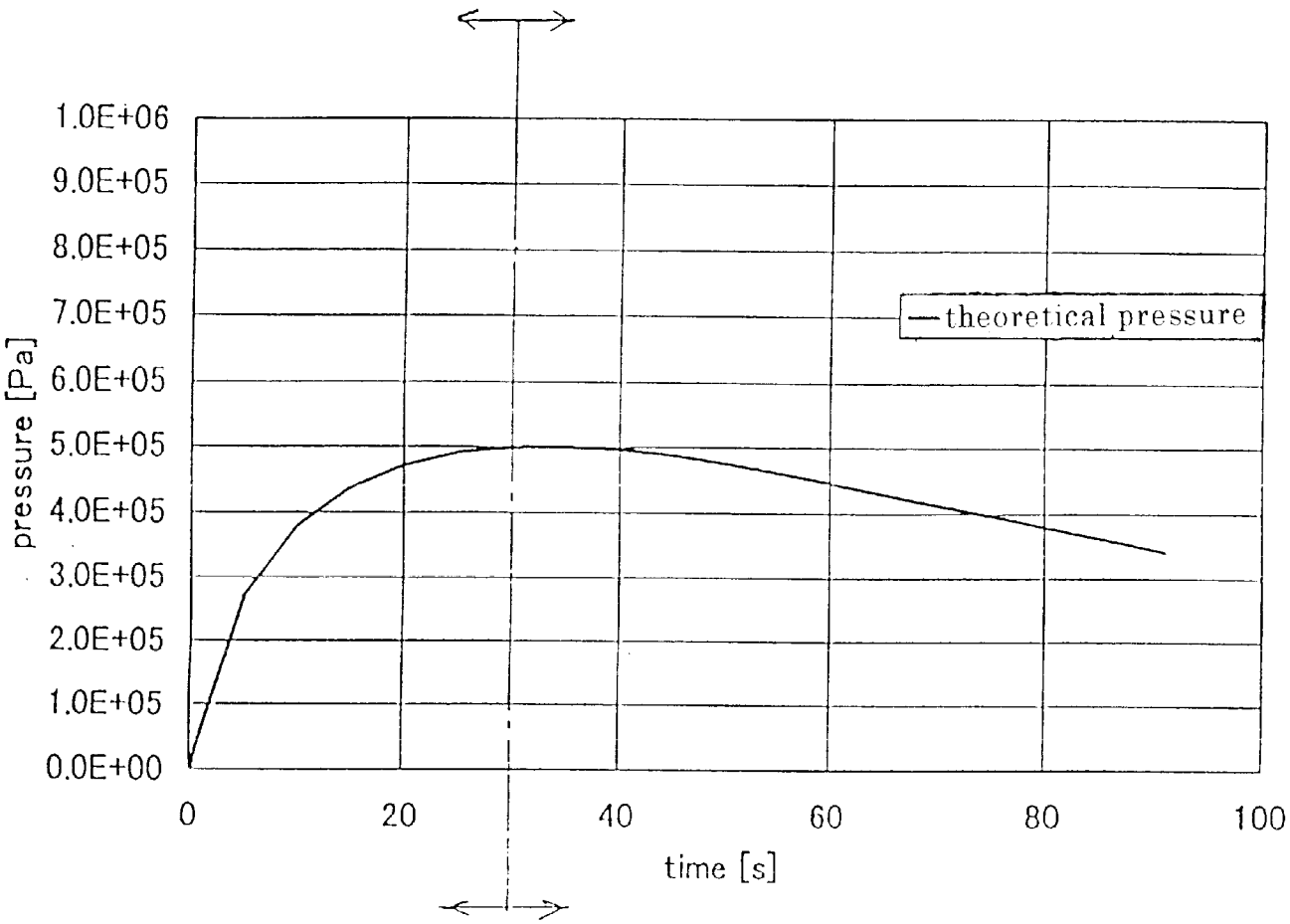
FIG. 4 is a graph showing a set pattern of a pneumatic pressure created by setting the maximum value of the strain rate of a superplastic metal sheet to be blow molded as a set value.

Since in the set pattern of the pneumatic pressure shown in FIG. 4 the pressure rises to 0.5 MPa and then drops to 0.35 MPa, in this embodiment the values of the parameters of the PID control are obtained by the limiting sensitivity method and by targeting a fixed command control wherein the pressure in the cavities of the upper and lower molds 9, 10 is kept, as a mean value, at a constant value of 0.3 MPa. The obtained values of the parameters of the PID control are 4.8 for the proportional band, 7 for the integral time, and 1 for the derivative time (PID condition 1). When the pressure of the cavity is kept at 0.3 MPa, the plate P is not set between the upper and lower molds 9, 10, and an outlet for air provided in the lower mold 10 is plugged.

Figure 5:
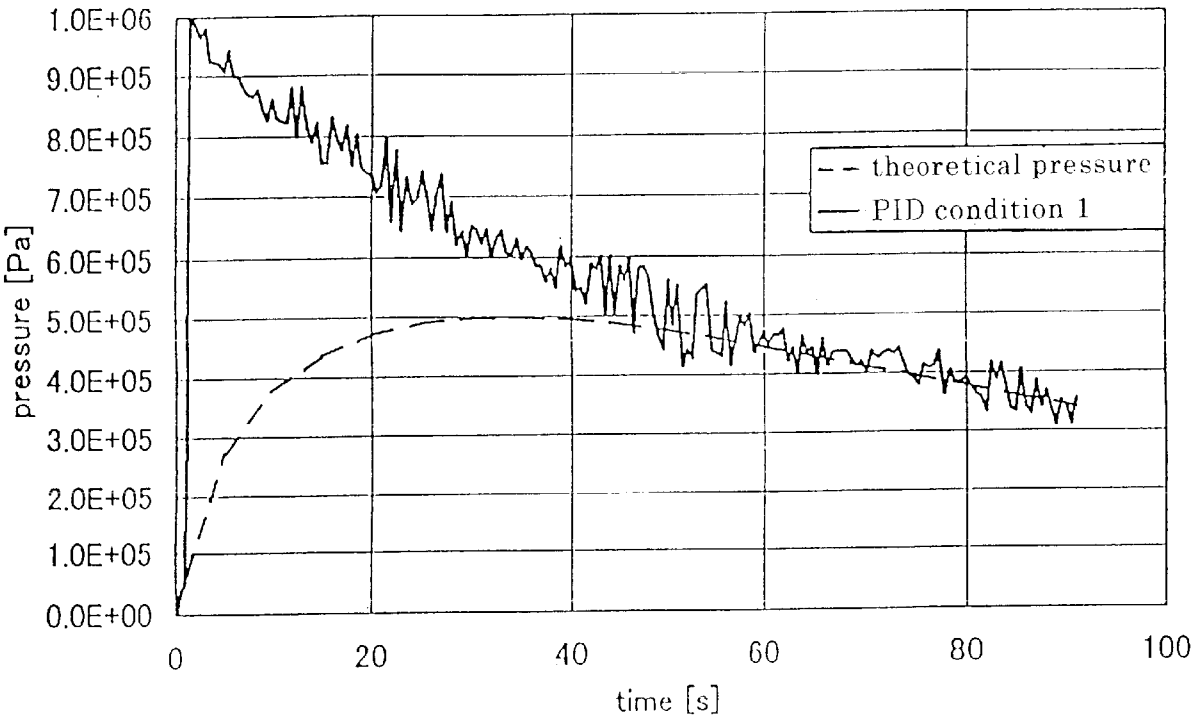
FIG. 5 is a graph showing the measurements of the pneumatic pressure when it is controlled under inappropriate conditions of parameters of a PID control.

The results of controlling the set pattern of the pneumatic pressure using the obtained values of the parameters are shown in FIG. 5 by the solid lines. (This is a case wherein the set pattern of the pneumatic pressure is not divided in relation to time.) The measurements of the pressure (PID condition 1 in FIG. 5), in particular, of the pressure when it rises, differ greatly from the set values (the theoretical pressure shown by a dotted line in FIG. 5). Thus the pressure of the cavity of the molds cannot be controlled under the PID condition 1. Thus step S3 (shown below) is necessary.

After step S2, the computer 2 receives the data on the pneumatic pressure from the pressure sensor 15 of the blow molding machine 3 and divides, in relation to time, the set pattern of the pneumatic pressure into an appropriate number of parts (step S3). When it is divided, preferably as shown in FIG. 4, it is divided into two parts, namely the first time zone, from 0–30 seconds, and the second time zone, after 30 seconds; the integral time for the part of the first time zone, where the pressure varies greatly, is made shorter to enhance its response; and the proportional band is made wider to restrain the tendency to be in a overshoot that may be caused by the enhancement of the response. Empirically, here the proportional band is made to be 4 times that of PID condition 1, i.e., to be 19.2; the integral time is made to be about one-half, i.e., to be 4; and the derivative time remains as 1. Since the pressure varies gradually in the second time zone, the parameters of the PID condition 1 are used for that part. (See FIG. 6, PID condition 2.)

Figure 7:
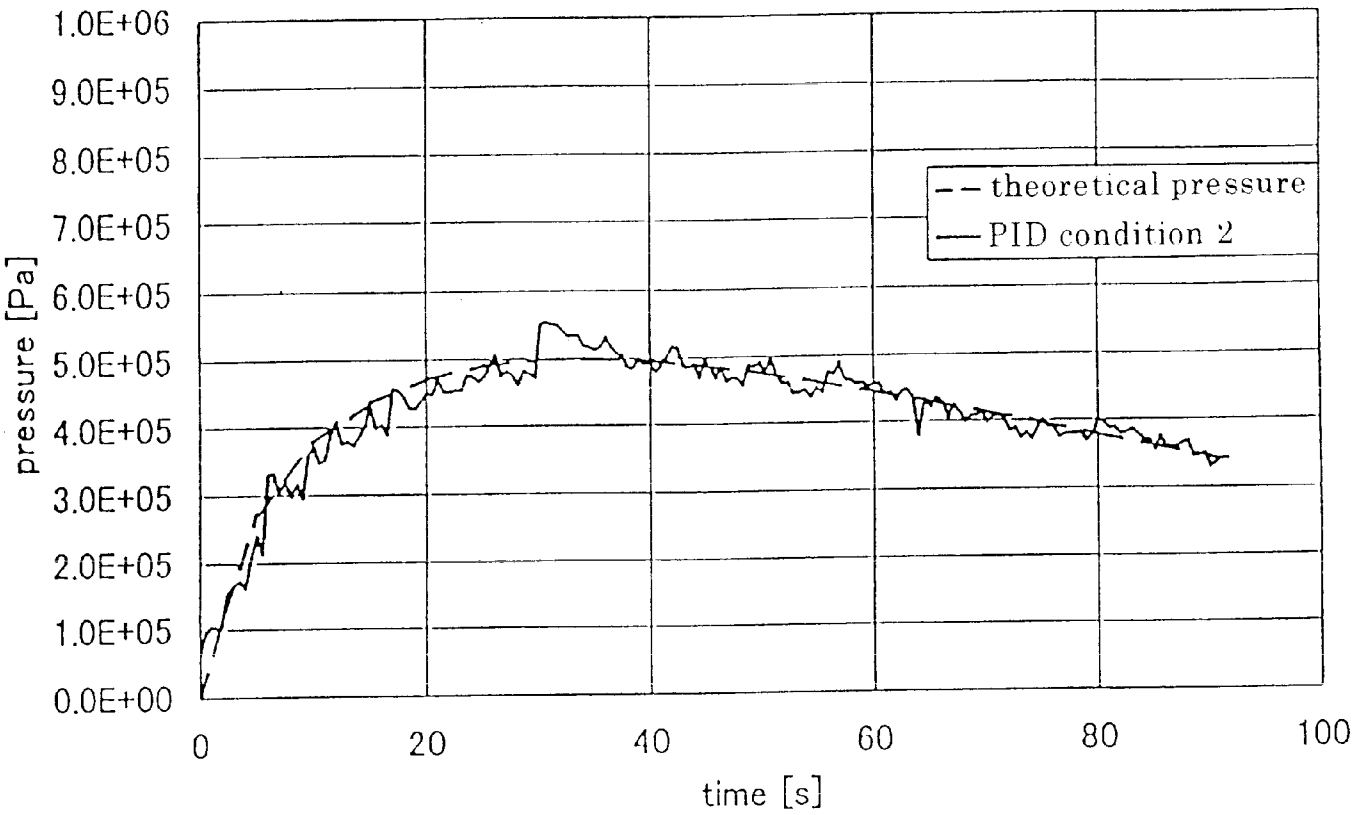
FIG. 7 is a graph showing the measurements of the pneumatic pressure when it is controlled under the appropriate condition of the parameters of the PID control.

The computer 2 then determines the values of the parameters for controlling the pneumatic pressure for the parts divided from the set pattern of the pneumatic pressure (step S4), subsequently controls a pattern of the pneumatic pressure based on the determined values of the parameter for controlling the pneumatic pressure, and enters the data on the pattern of the pneumatic pressure in the electropneumatic proportional control valve (step S5). These steps are sometimes repeated. As a result, the aluminum-alloy plate P is blow molded with the pneumatic pressure that is generated along the set pattern as shown in FIG. 7.

The embodiment explained above is exemplary only, and the scope of the invention is not limited to it. One skilled in the art will understand that many variations can be made to the embodiment. Thus the invention includes such variations. Its scope will be defined by the following claims.

What we claim is:

1. A method for blow molding a superplastic metal plate by in relation to time applying thereto pneumatic pressure that is based on a maximum value of a strain rate of the superplastic metal plate as a set pattern of pneumatic pressure in relation to time when the metal plate is subjected to a high-speed molding where the strain rate is more than $10^{-2}$(1/s), after being heated to a desired temperature, comprising the steps of:

entering data in a storage means on a shape into which a metal sheet is to be blow molded and on properties of a material of the metal sheet to store the data in the storage means;

determining a set pattern of a pneumatic pressure in relation to time from the entered data on the shape and the properties of the metal sheet;

dividing the set pattern of the pneumatic pressure into an appropriate number of parts in relation to time, wherein a first part divided from the set pattern of the pneumatic pressure is a first pattern area in which the pneumatic pressure varies relatively steeply, and wherein the remaining part divided from the set pattern of the pneumatic pressure is a second pattern area, following the first pattern area, in which the pneumatic pressure varies gradually compared with the first pattern area;

determining values of parameters for controlling the pneumatic pressure for each part divided from the set pattern of the pneumatic pressure, wherein the values of the parameters are determined by changing the values of the parameters of a proportional plus integral plus derivative control for the parts divided from the pattern of the pneumatic pressure; and controlling the pattern of the pneumatic pressure using the determined values of the parameters.

2. A system for blow molding a superplastic metal plate by in relation to time applying thereto a pneumatic pressure that is based on a maximum value of a strain rate of the superplastic metal plate as a set pattern of pneumatic pressure in relation to time when the metal plate is subjected to a high-speed blow molding where the strain rate is more than $10^{-2}$(1/s), after being heated to a desired temperature, comprising:

means for entering data on a shape into which a metal sheet is to be blow molded and on properties of a material of the metal sheet;

means for storing the data;

means for determining a set pattern of a pneumatic pressure in relation to time from the data on the shape and the properties of the metal sheet stored in the storing means;

means for dividing the set pattern of the pneumatic pressure into an appropriate number of parts in relation to time;

means for determining values of parameters for controlling the pneumatic pressure for each part divided from the set pattern of the pneumatic pressure; and means for controlling the pattern of the pneumatic pressure using the determined values of the parameters.

3. The system of claim 2, wherein the appropriate number of parts divided from the set pattern of the pneumatic pressure includes a first pattern area in which the pneumatic pressure varies relatively steeply and a second pattern area in which the pneumatic pressure varies gradually compared with the first pattern area.

* * * * *